US008236137B2

(12) United States Patent
Ruf et al.

(10) Patent No.: US 8,236,137 B2
(45) Date of Patent: Aug. 7, 2012

(54) HEADBOX FOR A MACHINE FOR PRODUCING A FIBROUS WEB

(75) Inventors: Wolfgang Ruf, Herbrechtingen (DE); Konstantin Fenkl, Gerstetten-Heldenfingen (DE); Markus Häuβler, Herbrechtingen (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/102,688

(22) Filed: May 6, 2011

(65) Prior Publication Data

US 2011/0265968 A1 Nov. 3, 2011

Related U.S. Application Data

(63) Continuation of application No. PCT/EP2009/063846, filed on Oct. 22, 2009.

(30) Foreign Application Priority Data

Dec. 18, 2008 (DE) ..... 10 2008 054 896

(51) Int. Cl.
*D21F 1/18* (2006.01)

(52) U.S. Cl. ..... 162/341

(58) Field of Classification Search ..... 162/341, 162/343

See application file for complete search history.

(56) References Cited

FOREIGN PATENT DOCUMENTS

| | | | |
|---|---|---|---|
| DE | 44 16 898 | A1 | 11/1995 |
| DE | 44 16 899 | A1 | 11/1995 |
| DE | 44 16 909 | A1 | 11/1995 |
| DE | 19926805 | A1 | 12/2000 |
| DE | 102 45 154 | A1 | 4/2004 |
| DE | 10 2008 043 145 | A1 | 4/2010 |
| DE | 10 2008 054 898 | A1 | 6/2010 |
| EP | 0629739 | B1 | 6/1994 |
| EP | 0 629 739 | A1 | 12/1994 |
| EP | 0 683 266 | A1 | 11/1995 |
| EP | 0 824 157 | A2 | 2/1998 |
| EP | 2 199 459 | A1 | 6/2010 |

OTHER PUBLICATIONS

International Search Report dated Jan. 22, 2010 for PCT/EP2009/063846 (2 pages).

(Continued)

*Primary Examiner* — Mark Halpern
(74) *Attorney, Agent, or Firm* — Taylor IP, P.C.

(57) ABSTRACT

The invention relates to a headbox which comprises a feed device feeding the at least one fiber suspension, a perforated distribution pipe plate arranged immediately downstream thereof and having a plurality of channels arranged in lines and columns, an intermediate channel arranged downstream thereof, extending over the width of the headbox and having a plurality of means for dosing a fluid in partial fluid streams to the at least one fiber suspension in a preferably adjustable/controlled manner, the means being spaced apart from each other in the width direction of the headbox and the individual means comprising a plurality of dosing channels having respective dosing channel openings and an opening center line, arriving at different levels and being connected to a common supply channel. The headbox further comprises a downstream turbulence generator having a plurality of flow channels arranged in lines and columns and a headbox nozzle which is directly contiguous to the turbulence generator and which has a nozzle gap. The headbox according to the invention has a system pressure loss which is substantially composed of a first pressure loss between the feed device and the intermediate channel and a second pressure loss in the turbulence generator, the second pressure loss and the first pressure loss being in a ratio ranging from 8:1 to 1:1, preferably from 4:1 to 1:1, particularly from 2:1 to 1:1.

20 Claims, 2 Drawing Sheets

OTHER PUBLICATIONS

Written Opinion of the International Searching Authority (undated) for PCT/EP2009/063846 (6 pages).
International Search Report dated Jan. 22, 2010 for PCT/EP2009/063837 (2 pages).
English translation of International Preliminary Report on Patentability dated Jun. 21, 2011 for PCT/EP2009/063837 (7 pages).
English translation of Written Opinion of the International Searching Authority (undated) for PCT/EP2009/063837 (6 pages).
International Search Report dated Jan. 22, 2010 for PCT/EP2009/063838 (2 pages).
English translation of International Preliminary Report on Patentability dated Jun. 21, 2011 for PCT/EP2009/063838 (8 pages).
English translation of Written Opinion of the International Searching Authority (undated) for PCT/EP2009/063838 (7 pages).
English translation of International Preliminary Report on Patentability dated Jun. 21, 2011 for PCT/EP2009/063846 (7 pages).
English translation of Written Opinion of the International Searching Authority (undated) for PCT/EP2009/063846 (6 pages).

HEADBOX FOR A MACHINE FOR PRODUCING A FIBROUS WEB

CROSS REFERENCE TO RELATED APPLICATIONS

This is a continuation of PCT application No. PCT/EP2009/063846, entitled "HEADBOX FOR A MACHINE FOR PRODUCING A FIBROUS WEB", filed Oct. 22, 2009, which is incorporated herein by reference.

BACKGROUND OF THE INVENTION

1. Field of the Invention

The invention relates to a headbox for a machine for producing a fibrous web, in particular a paper or cardboard web from at least one fibrous stock suspension which comprises a feed device feeding the at least one fibrous stock suspension, a perforated distribution pipe plate arranged immediately downstream thereof and having a plurality of channels arranged in rows and columns, an intermediate channel arranged downstream thereof, extending over the width of the headbox and having a plurality of means for dosing of a fluid in partial fluid streams to the at least one fibrous stock suspension in a preferably adjustable/controllable manner, the means being spaced apart from each other in width direction of the headbox and the individual means comprising a plurality of dosing channels having respective dosing channel openings and an opening center line, discharging at different heights and being connected to a common supply channel. The headbox further comprises a downstream turbulence generator having a plurality of flow channels arranged in rows and columns and a headbox nozzle comprising a nozzle gap, located immediately adjacent to the turbulence generator.

2. Description of the Related Art

A headbox of this type is known for example from German disclosure documents DE 44 16 898 A1, DE 44 16 899 A1 and DE 44 16 909 A1.

German disclosure document DE 44 16 898 A1 describes a headbox for a paper machine; including a feed device for the stock suspension comprising a guiding element with a plurality of channels; upstream from a guiding element a mixing chamber with several infeed devices which are distributed over the headbox for a fluid which is to be added into the stock suspension and which differs in its characteristics from the stock suspension; and with a nozzle chamber forming an outlet opening for the stock suspension, located immediately downstream from the guiding element. The feed devices for the fluid which is to be added extend essentially vertically in the mixing chamber and comprise several dosing openings located on top of each other.

German disclosure document DE 44 16 899 A1 describes a headbox for a paper machine including a feed device for the stock suspension, with a first guiding element comprising a plurality of channels, a second guiding element comprising a plurality of channels, a mixing chamber located between them, a contiguous nozzle chamber forming an outlet opening for the stock suspension, and several feed lines distributed over the headbox for the fluid which is to be added. The majority of the channels of the guiding elements are positioned and dimensioned so that the outlet opening of the upstream guiding element is not aligned with a confluence into the downstream guiding element. The feed lines for the fluid which is to be added are equipped with dosing openings, the majority of which align respectively with a confluence into the downstream guiding element.

In addition, German disclosure document DE 44 16 909 A1 describes a headbox for a paper machine with a feed device for the stock suspension, a downstream contiguous guiding element equipped with a plurality of channels, located downstream thereto a mixing chamber extending across the width of the headbox with several separation walls distributed across the headbox and extending essentially in flow direction, as well as feed devices for a fluid which is to be added, distributed in cross direction of the headbox and which are equipped with dosing openings, downstream an additional guiding element equipped with a plurality of channels and adjacent to it, one nozzle chamber forming an outlet opening for the stock suspension.

The feed devices for the fluid which is to be added extend into the mixing chamber and the sectional area which is formed in the mixing chamber by the separation walls begins in the region of the dosing openings from where it extends essentially in flow direction to the second guiding element.

Based on their operational conditions the head boxes described in these three documentations possibly display unstable operating characteristics which are reflected especially in the properties of the fibrous web which is to be produced. The negatively influenced properties can be especially the base weight and the fiber orientation in the fibrous web which is to be produced. In addition, usage of chemicals, especially retention agents can be high. Also, the pressure requirement of a headbox is used in a manner known to the expert, for the fluidization of the at least one fibrous stock suspension, for homogenization and orientation of the flow and for acceleration of the at least one fibrous stock suspension in the headbox nozzle. The pressures required for homogenization or respectively orientation and fluidization are losses.

It is therefore the objective of the current invention, and what is needed in the art is, to improve a headbox of the type described at the beginning in such a manner, that the aforementioned disadvantages of the current state of the art are significantly, preferably completely eliminated. To provide a distribution of the fibrous stock suspension which is preferably as uniform as possible the pressure loss should be as low as possible and optimally distributed. Also, the energy consumption of the headbox should be significantly reduced, the stability of the fiber orientation (cross) profile improved and the usage of chemicals, especially retention agents reduced.

SUMMARY OF THE INVENTION

According to the present invention this objective is met with, and the present invention provides, a headbox of the type described at the beginning in that, based on its design it shows a system pressure loss which is substantially composed of a first pressure loss between the feed device and the intermediate channel and a second pressure loss in the turbulence generator, whereby the second pressure loss and the first pressure loss are in a ratio in a range of 8:1 to 1:1, preferably of 4:1 to 1:1, especially of 2:1 to 1:1.

The inventive objective is completely met in this manner.

The inventive design of the headbox of the type described at the beginning provides a far reaching, preferably complete elimination of the aforementioned disadvantages of the current state of the art and a substantially improved realization especially of the technological requirements. The pressure loss in particular is kept as low as possible and optimally distributed, for distribution of the fibrous stock suspension, so that the continuous production of a high quality fibrous web becomes possible. In addition, the energy consumption of the headbox is significantly reduced and a good to very good functional fulfillment of the headbox with the described dosing system is still sufficiently ensured, even with possibly greater changes in the operating conditions. And, the stability of the fiber orientation (cross) profile is improved; the usage of chemicals, especially retention agents is reduced.

In addition, at least one separation element which is well known to the expert, in particular a lamella may be provided in the headbox nozzle of the inventive headbox. In the event that several separating elements, in particular lamellas are arranged in the headbox nozzle of the inventive headbox, different lengths and possibly also different properties such as surface profiles and similar may occur.

The second pressure loss in the intermediate channel is preferably in a range of 0.1 to 1.5 bar, preferably 0.2 bar to 1.0 bar, especially 0.3 to 0.5 bar.

In an additional design form the feed device includes a cross distribution pipe mounted to the perforated distribution pipe plate, and the perforated distribution pipe plate is equipped with hydraulic elements for pressure recovery, for examples with diffusers, step diffusers or similar equipment. This flow control allows a trouble free and obstruction free flow into the perforated distribution pipe plate in the distribution pipe at a speed in the range of 4 to 16 m/s. The diffusers in the perforated distribution pipe plate convert this flow energy again into pressure.

In an alternative design form the feed device includes a central distributor, equipped with a plurality of tubes which are connected with the channels in the perforated distribution pipe plate. And, the plurality of tubes is equipped with hydraulic elements for pressure recovery, for example with diffusers, step diffusers or similar equipment. In this feed design the system can be designed for low flow speeds of less than 10 m/s in the tubes.

Also, the at least one fibrous stock suspension which is supplied to the feed device can be fed exclusively to the channels of the perforated distribution pipe plate arranged adjacent downstream. Herewith a headbox without recirculation of the fibrous stock suspension can be realized and the volume of fibrous stock suspension on the edge varies substantially less.

The impingement point of the center line of the individual dosing opening onto the turbulence generator can be located approximately central, preferably central between the two column planes of two adjacent flow channels. With this design form the throughput constancy of fluid in width direction of the headbox in the turbulence generator can be rendered independent from the different volumes of fibrous stock suspension which can be added in width direction of the headbox.

The dosing channel opening of the means for preferably adjustable/controllable dosing of the fluid in partial fluid streams into the at least one fibrous stock suspension is moreover positioned preferably at a vertical distance from the turbulence generator in the range of 1 to 100 mm, preferably 3 to 50 mm, especially 5 to 30 mm. These ranges in distance allow for the necessary blending quality of the fluid with the fibrous stock suspension, even with different operating parameters, so that optimum parameters are given for the production of a fibrous web having good to very good quality properties.

The respective means for preferably adjustable/controllable dosing of fluid in partial fluid streams into the at least one fibrous stock suspension preferably comprises a dosing sword as described and illustrated in the German patent application DE 10 2008 054 898.7 (Applicant File: HPA14265 DE and Applicant-Title:"MJ II-DoS-TE-Geometry") with same German application date as the German patent application corresponding to the present application. The relating disclosure content of German patent application DE 10 2008 054 898.7 is herewith made subject matter of the current description.

The fluid consists preferably of water, especially clarified water or of a fibrous stock suspension, especially white water whose concentration is different than the average concentration of the at least one fibrous stock suspension in the headbox. These types of fluids have already proven themselves well in similar applications.

The inventive headbox is extremely well suited for utilization in a machine for the production of a fibrous web, especially a paper or cardboard web. The fibrous web produced in the machine with at least one inventive headbox without exception possesses outstanding properties, since among other advantages, control of its fiber orientation cross profile as well as its base weight cross profile is possible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
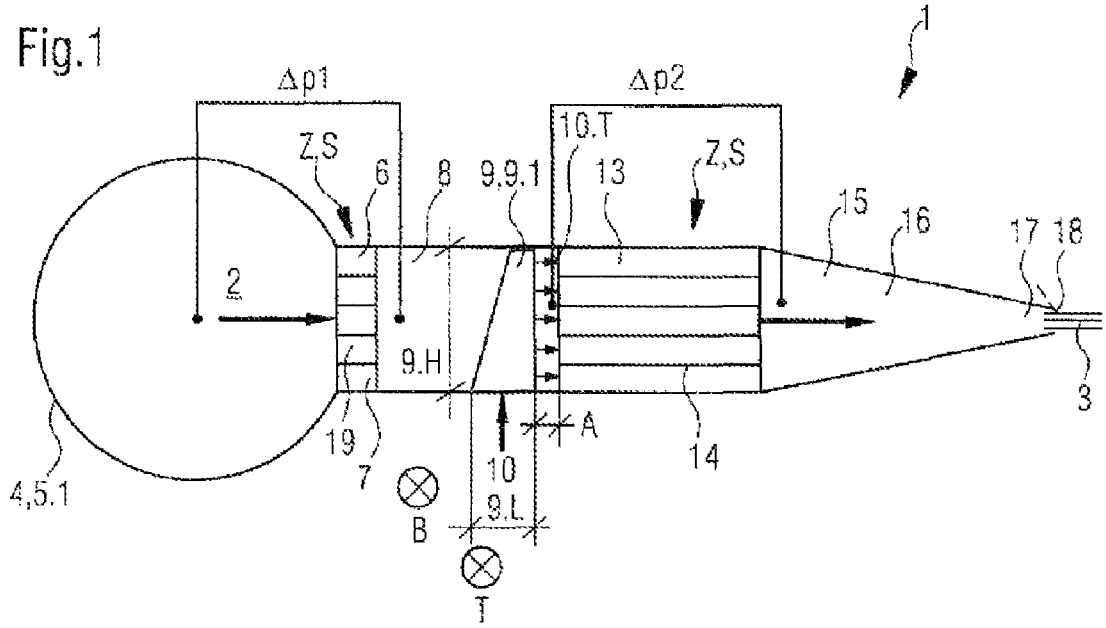
FIG. 1 is a vertical and schematic longitudinal sectional view of a first inventive design form of a headbox for a machine to produce a fibrous web from at least one fibrous stock suspension.

FIG. 1 shows a vertical and schematic longitudinal sectional view of a headbox 1 for a machine for producing a fibrous web 3 from a fibrous stock suspension 2 (arrow). Illustrated headbox 1 can obviously also be designed as a multi-layer headbox utilizing at least two different fibrous stock suspensions to produce the fibrous web 3. Fibrous web 3 can in particular be a paper, cardboard or tissue web.

Headbox 1 comprises one feed device 4 in the embodiment of a cross distribution pipe 5.1 which is known to the expert, supplying the one fibrous stock suspension 2 (arrow).

Perforated distribution pipe plate 6 which is equipped with a plurality of channels 7 which are arranged in rows Z and columns S is located downstream adjacent to feed device 4.

Again located adjacent downstream from perforated distribution pipe plate 6 is an intermediate channel 8, extending across width B (arrow) of headbox 1 and being equipped with several means 9 for a preferably adjustable/controllable dosing of a fluid 10 in partial fluid streams 10.T (arrows) into the fibrous stock suspension 2 (arrow), the means being spaced apart from each other in width direction of headbox 1. The individual means 9 for the preferably adjustable/controllable dosing respectively comprises several dosing channels 11 (compare FIG. 4) having respective dosing channel openings (11.O) and an opening center line (11.M), discharging at different heights and being connected to a common supply channel 12. The individual means 9 for preferably adjustable/controllable dosing is embodied by a dosing sword 9.1.

A turbulence generator 13 having a plurality of flow channels 14 arranged in rows Z and column S is located downstream from intermediate channel 8. During operation of headbox 1 the fibrous stock suspension 2 (arrow) is divided into partial fibrous stock suspension streams in turbulence generator 13 and, after emerging from the turbulence generator is brought together again in a machine-wide chamber 15 in the embodiment of a headbox nozzle 16 comprising a nozzle gap 17 in order to enable formation of a machine-wide fibrous web 3. As already known, flow channels 14 are in the embodiment of preferably thin-walled turbulence pipes and/or turbulence pipe inserts with at least partially constant, at least partially divergent, at least partially convergent and/or stepped cross sectional surfaces. A separating element which is well known to the expert and which is not explicitly illustrated, especially a lamella, may also be provided in headbox nozzle 16. If a multitude of separating elements, especially lamellas are provided in headbox nozzle 16, they can have different lengths and possibly also different properties, such as surface profiles, etc.

As indicated by broken lines, on its outlet side headbox nozzle 16 may be equipped with an aperture 18, at least on one side which is indicated by broken lines.

Due to its design, headbox 1 has a system pressure loss which is substantially composed of a first pressure loss Δp1 between feed device 4 and intermediate channel 8, and a second pressure loss Δp2 in turbulence generator 13, the second pressure loss Δp2 and the first pressure loss Δp1 being in a ratio in a range of 8:1 to 1:1, preferably 4:1 to 1:1, especially 2:1 to 1:1. The second pressure loss Δp2 in turbulence generator 13 is in a range of 0.1 to 1.5 bar, preferably 0.2 to 1.0 bar, especially 0.3 to 0.5 bar.

Figure 3:
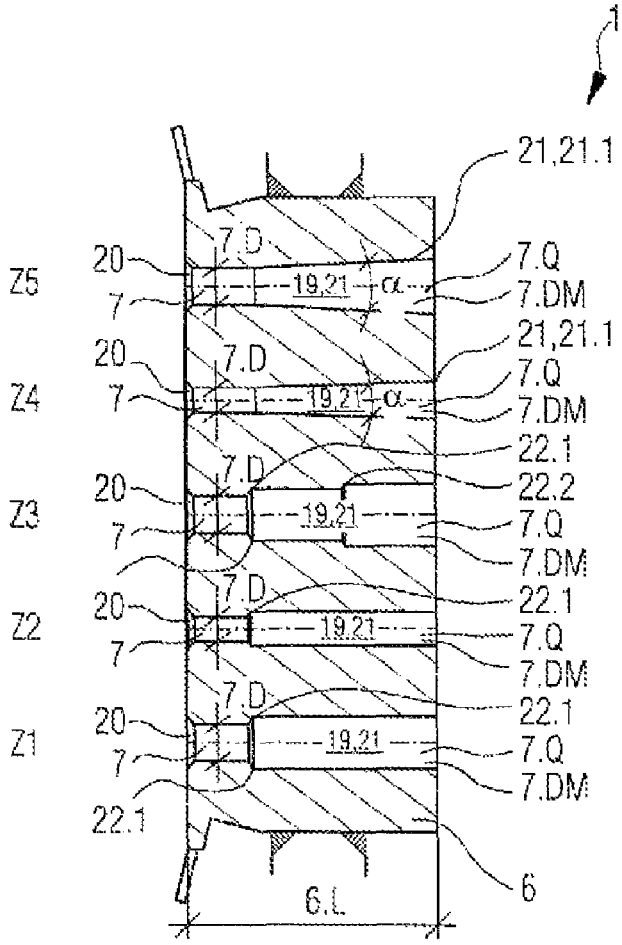
FIG. 3 is a vertical and schematic longitudinal sectional view of a perforated distribution pipe plate for an inventive headbox for a machine to produce a fibrous web from at least one fibrous stock suspension, with different channel cross sections.

Perforated distribution pipe plate 6 is equipped with hydraulic elements 19 for pressure recovery, for examples with diffusers, step diffusers or similar equipment (compare FIG. 3).

Furthermore, fibrous stock suspension 2 which is supplied to feed device 4 is fed exclusively to channels 7 of perforated distribution pipe plate 6 arranged adjacent downstream. Headbox 1 therefore shows no recirculation for the fibrous stock suspension 2 fed to it by means of feed device 4.

Impingement point P of opening center line 11.M of individual dosing opening 11.O of dosing channel 11 onto turbulence generator 13 is located approximately central, preferably central between the two column planes of two adjacent flow channels 14 of turbulence generator 13. Dosing channels 11 of means 9 in the form of dosing sword 9.1 for preferably adjustable/controllable dosing discharging at different height levels are located at equal distances, and dosing channel 11—connected with respective common supply channel 12—of means 9 for preferably adjustable/controllable dosing has a circular cross sectional surface 11.Q with a diameter of 11.D of 2 to 10 mm, preferably 4 to 6 mm. In contrast, common supply channel 12 of means 9 for preferably adjustable/controllable dosing has a circular cross sectional surface 12.Q with a diameter 12.D of 6 to 20 mm, preferably 10 to 15 mm (compare FIG. 4).

Means 9 in the form of dosing sword 9.1 for preferably adjustable/controllable dosing has a length 9.L in the range of 60 to 350 mm, preferably 100 to 250 mm and, depending upon the height of the intermediate chamber of headbox 1 has a height 9.H in the range of 50 to 300 mm, preferably 75 to 250 mm. Means 9 for preferably adjustable/controllable dosing are at a preferably uniform spacing T in width direction of headbox 1 in the range of 10 to 100 mm, preferably 25, 33, 50 or 66 mm.

Dosing sword 9.1 is described and illustrated in the German patent application DE 10 2008 054 898.7 (Applicant File: HPA14265 DE and Applicant-Title: "MJ II-DoS-TE-Geometry") with same German application date as the German patent application corresponding to the present application. The relating disclosure content of German patent application DE 10 2008 054 898.7 is herewith made to the subject matter of the current description.

Figure 4:
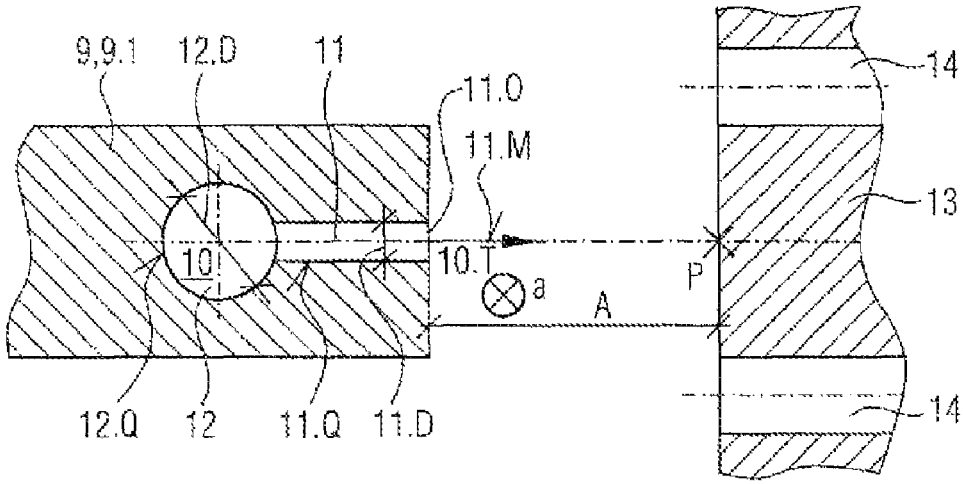
FIG. 4 is a schematic detailed illustration of the means for preferably adjustable/controllable dosing of fluid in partial fluid streams.

Moreover, dosing opening 11.O of means 9 for preferably adjustable/controllable dosing of fluid 10 in partial fluid streams 10.T (arrows) into fibrous stock suspension 2 is positioned preferably at vertical distance A in the range of 2 to 100 mm, preferably 3 to 50mm, especially 5 to 30 mm from turbulence generator 13 (compare FIG. 4).

Figure 2:
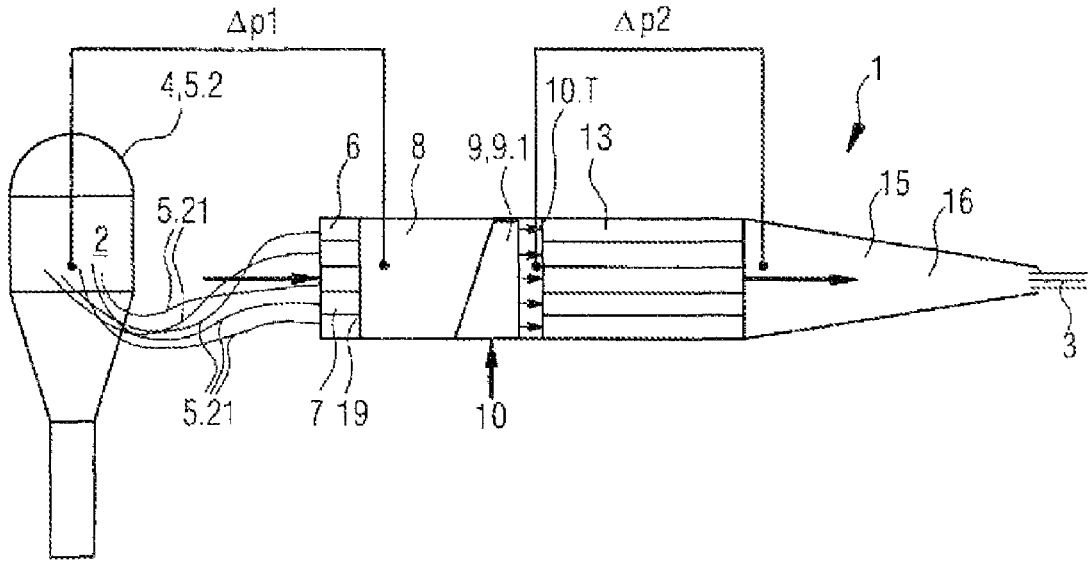
FIG. 2 is a vertical and schematic longitudinal sectional view of a second inventive design form of a headbox for a machine to produce a fibrous web from at least one fibrous stock suspension.

FIG. 2 shows a vertical and schematic longitudinal sectional view of a second inventive design form of a headbox 1 for a machine to produce a fibrous web 3 from at least one fibrous stock suspension 2. The basic construction of this headbox 1 is substantially consistent with the basic construction of headbox 1 schematically depicted in FIG. 1. We therefore refer to the description provided for that drawing.

Feed device 4 of this headbox 1 includes a central distributor 5.2, equipped with a plurality of tubes 5.21. Said tubes 5.21 are connected with channels 7—which are arranged in rows Z and in columns S—of perforated distribution pipe plate 6. Central distributor 5.2 which is known to the expert is generally also referred to as round distributor.

Perforated distribution pipe plate 6 is again equipped with hydraulic elements 19 for pressure recovery, for examples with diffusers, step diffusers or similar equipment (compare FIG. 3).

Due to its design, headbox 1 also has a system pressure loss which is essentially composed of a first pressure loss Δp1 between feed device 4 and intermediate channel 8, and a second pressure loss Δp2 in the turbulence generator, the second pressure loss Δp2 and the first pressure loss Δp1 being in a ratio in a range of 8:1 to 1:1, preferably 4:1 to 1:1, especially 2:1 to 1:1. The second pressure loss Δp2 in turbulence generator 13 is in a range of 0.1 to 1.5 bar, preferably 0.2 to 1.0 bar, especially 0.3 to 0.5 bar.

A separating element which is well known to the expert and which is not explicitly illustrated, especially a lamella, may also be provided in headbox nozzle 16. If a multitude of separating elements, especially lamellas are provided in headbox nozzle 16, they can have different lengths and possibly also different properties, such as surface profiles, etc.

FIG. 3 shows a vertical and schematic longitudinal sectional view of a perforated distribution pipe plate 6 for the inventive headbox 1 for a machine to produce a fibrous web from at least one fibrous stock suspension, with five channels 7 having different channel cross sections 7.Q.

Perforated distributor pipe plate 6 comprises five rows Z1 through Z5 of channels 7 and a plurality of columns S of channels 7. All channels 7 have without exception a round channel cross section 7.Q, however in different forms and designs. All channels 7 are also equipped on their inlet side with an inlet chamfer 20 which is known to the expert.

Channels 7 of the two upper rows Z4, Z5 initially have a constant channel cross section 7.Q which lastly experiences a continuous expansion 21, especially a cone 21.1 with a cone angle a of ≦30°.

Channels 7 of middle row Z3 have again initially a constant channel cross section 7.Q which lastly experience two rapid expansions 22, especially step expansions 22.1, 22.2.

Channels 7 of the two lower rows Z1, Z2 have again initially a constant channel cross section 7.Q which lastly experience only one rapid expansion 22, especially one step expansion 22.1.

Each individual channel 7 of perforated distribution pipe plate 6 therefore initially has a round channel cross section 7.Q with a channel diameter 7.D and then also forms a hydraulic element 19 for pressure recovery based on at least one expansion 21, 22. The middle channel diameter 7.DM of channel 7 of perforated distribution pipe plate 6 and length 6.L of perforated distribution pipe plate 6 have a ratio of 1:2 to 1:10, preferably 1:3 to 1:8, especially 1:4 to 1:5.

FIG. 4 shows a schematic illustration of means 9 for preferably adjustable/controllable dosing of fluid 10 in partial fluid streams 10.T (arrow).

Dosing channels 11 of means 9 for preferably adjustable/controllable dosing which discharge at different height levels are located at equal distances, and dosing channel 11—connected with respective common supply channel 12—of means 9 for preferably adjustable/controllable dosing has a circular cross sectional surface 11.Q with a diameter of 11.D of 2 to 10 mm, preferably 4 to 6 mm. In contrast, common supply channel 12 of means 9 for the preferably adjustable/controllable dosing has a circular cross sectional surface 12.Q with a diameter 12.D of 6 to 20 mm, preferably 10 to 15 mm. The impingement point P of opening center line 11.M of individual dosing opening 11.O of dosing channel 11 onto turbulence generator 13 is located approximately central, preferably central between the two column planes of two adjacent flow channels 14 of turbulence generator 13.

Fluid 10 flowing through respective headboxes 1 illustrated in FIGS. 1 through 4 consists at least of water, especially white water or clarified water or of a fibrous stock suspension whose concentration is different than the average concentration of the at least one fibrous stock suspension 2 flowing through the at least one headbox 1.

Headbox 1 illustrated in the respective figures is especially suited for utilization in a machine to produce a fibrous web 3, in particular a paper or cardboard web from at least one fibrous stock suspension 2.

In summary it must be stated that a headbox of the type described at the beginning is improved by the invention in that the aforementioned disadvantages of the current state of the art are eliminated to the greatest possible extent, preferably completely. The pressure loss for distribution of the fibrous stock suspension that is as uniform as possible is hereby kept as low as possible and is optimally distributed. The energy consumption of the headbox is also significantly reduced, the stability of the fiber orientation (cross) profile is improved and the use of chemicals, especially retention agents is reduced.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

1 Headbox
2 Fibrous stock suspension (arrow)
3 Fibrous web
4 Feed device
5.1 Cross distributing pipe
5.2 Central distributor
5.21 Tube
6 Perforated distributor pipe plate
6.L Length
7 Channel
7.DM Middle channel diameter
7.Q Channel cross section
8 Intermediate channel
9 Means for preferably adjustable/controllable dosing of a fluid
9.H Height
9.L Length
10 Fluid (arrow)
10.T Partial fluid stream (arrow)
11 Dosing channel
11.D Diameter
11.M Opening center line
11.O Dosing opening
11.Q Cross sectional surface
12 Supply channel
12.D Diameter
12.Q Cross sectional surface
13 Turbulence generator
14 Flow channel
15 Chamber
16 Headbox nozzle
17 Nozzle gap
18 Aperture
19 Hydraulic element
20 Inlet chamfer
21 Continuous expansion
21.1 Cone
22 Rapid expansion
221. Step expansion
22.2 Step expansion
A Distance
a Distance
B Width (arrow)
P Impingement point
T Separation
S Column
Z Row
Δp1 First pressure loss
Δp2 Second pressure loss
α Cone angle

What is claimed is:

1. A headbox for a machine for producing a web of fibrous material from at least one fibrous stock suspension, the web being one of a paper web and a cardboard web, said headbox comprising:

a feed device feeding the at least one fibrous stock suspension;

a perforated distribution pipe plate arranged immediately downstream from said feed device and having a plurality of channels arranged in a plurality of rows and a plurality of columns;

an intermediate channel arranged downstream from said perforated distribution pipe plate, extending over a width of the headbox, and having a plurality of devices for dosing of a fluid in a plurality of partial fluid streams into the at least one fibrous stock suspension in at least one of an adjustable and a controllable manner, said intermediate channel including a common supply channel, said plurality of devices individually being spaced apart from each other in a width direction of the headbox, said plurality of devices individually including a plurality of dosing channels, said plurality of dosing channels including respectively a dosing channel opening and an opening center line, said plurality of dosing channels discharging at different heights and being connected to said common supply channel;

a turbulence generator downstream from said intermediate channel and having a plurality of flow channels arranged in a plurality of rows and a plurality of columns; and a headbox nozzle including a nozzle gap, said headbox nozzle being located immediately adjacent to said turbulence generator, the headbox being configured for showing a system pressure loss which is substantially composed of a first pressure loss between said feed device and said intermediate channel and a second pressure loss in said turbulence generator, said second pressure loss and said first pressure loss being in a ratio in a range of 8:1 to 1:1.

2. The headbox according to claim 1, wherein said second pressure loss and said first pressure loss are in a ratio in a range of 4:1 to 1:1.

3. The headbox according to claim 1, wherein said second pressure loss and said first pressure loss are in a ratio in a range of 2:1 to 1:1.

4. The headbox according to claim 1, wherein said second pressure loss in said turbulence generator is in a range of 0.1 to 1.5 bar.

5. The headbox according to claim 1, wherein said second pressure loss in said turbulence generator is in a range of 0.2 to 1.0 bar.

6. The headbox according to claim 1, wherein said second pressure loss in said turbulence generator is in a range of 0.3 to 0.5 bar.

7. The headbox according to claim 1, wherein said feed device includes a cross distribution pipe mounted to said perforated distribution pipe plate, said perforated distribution pipe plate being equipped with a plurality of hydraulic elements for pressure recovery.

8. The headbox according to claim 7, wherein said plurality of hydraulic elements are one of a plurality of diffusers and a plurality of step diffusers.

9. The headbox according to claim 1, wherein said feed device includes a central distributor which is equipped with a plurality of tubes which are connected with said plurality of channels in said perforated distribution pipe plate.

10. The headbox according to claim 9, wherein said plurality of tubes are equipped with a plurality of hydraulic elements for pressure recovery.

11. The headbox according to claim 9, wherein said plurality of hydraulic elements are one of a plurality of diffusers and a plurality of step diffusers.

12. The headbox according to claim 1, wherein the at least one fibrous stock suspension which is supplied to said feed device can be fed exclusively to said plurality of channels of said perforated distribution pipe plate arranged adjacent downstream.

13. The headbox according to claim 1, wherein an impingement point of a respective said opening center line of a respective said dosing channel opening onto said turbulence generator is located approximately central between two column planes of two adjacent ones of said plurality of flow channels.

14. The headbox according to claim 1, wherein an impingement point of a respective said opening center line of a respective said dosing channel opening onto said turbulence generator is located central between two column planes of two adjacent ones of said plurality of flow channels.

15. The headbox according to claim 1, wherein said dosing channel opening of each respective one of said plurality of devices for at least one of adjustable and controllable dosing of said fluid in said plurality of partial fluid streams into the at least one fibrous stock suspension is positioned at a vertical distance from said turbulence generator in a range of 2 to 100 mm.

16. The headbox according to claim 1, wherein said dosing channel opening of each respective one of said plurality of devices for at least one of adjustable and controllable dosing of said fluid in said plurality of partial fluid streams into the at least one fibrous stock suspension is positioned at a vertical distance from said turbulence generator in a range of 3 to 50 mm.

17. The headbox according to claim 1, wherein said dosing channel opening of each respective one of said plurality of devices for at least one of adjustable and controllable dosing of said fluid in said plurality of partial fluid streams into the at least one fibrous stock suspension is positioned at a vertical distance from said turbulence generator in a range of 5 to 30 mm.

18. The headbox according to claim 1, wherein said plurality of devices for at least one of adjustable and controllable dosing of said fluid in said plurality of partial fluid streams into the at least one fibrous stock suspension each includes a dosing sword.

19. The headbox according to claim 1, wherein said fluid consists of one of water and at least one fibrous stock suspension whose concentration is different than an average concentration of the at least one fibrous stock suspension flowing through at least one said headbox, said water being one of white water and clarified water.

20. A machine to produce a web of fibrous material from at least one fibrous stock suspension, the web being one of a paper web and a cardboard web, said machine comprising:

at least one headbox including:

a feed device feeding the at least one fibrous stock suspension;

a perforated distribution pipe plate arranged immediately downstream from said feed device and having a plurality of channels arranged in a plurality of rows and a plurality of columns;

an intermediate channel arranged downstream from said perforated distribution pipe plate, extending over a width of said at least one headbox, and having a plurality of devices for dosing of a fluid in a plurality of partial fluid streams into the at least one fibrous stock suspension in at least one of an adjustable and a controllable manner, said intermediate channel including a common supply channel, said plurality of devices individually being spaced apart from each other in a width direction of the headbox, said plurality of devices individually including a plurality of dosing channels, said plurality of dosing channels including respectively a dosing channel opening and an opening center line, said plurality of dosing channels discharging at different heights and being connected to said common supply channel;

a turbulence generator downstream from said intermediate channel and having a plurality of flow channels arranged in a plurality of rows and a plurality of columns; and a headbox nozzle including a nozzle gap, said headbox nozzle being located immediately adjacent to said turbulence generator, said at least one headbox being configured for showing a system pressure loss which is substantially composed of a first pressure loss between said feed device and said intermediate channel and a second pressure loss in said turbulence generator, said second pressure loss and said first pressure loss being in a ratio in a range of 8:1 to 1:1.

* * * * *